United States Patent [19]

Sands

[11] Patent Number: 4,597,527

[45] Date of Patent: Jul. 1, 1986

[54] TOY WATER GUN WITH A MULTIPLICITY OF OPERATION MODES

[76] Inventor: Ned R. Sands, 2230 Holly Ave., Escondido, Calif. 92027

[21] Appl. No.: 553,037

[22] Filed: Nov. 18, 1983

[51] Int. Cl.[4] ..... B67D 5/42; B67D 5/52

[52] U.S. Cl. ..... 239/394; 239/444; 222/79; 222/137; 222/144.5; 222/330; 222/387; 222/520; 272/27 N

[58] Field of Search ..... 222/79, 330, 485, 144.5, 222/137, 566, 145, 567, 386, 575, 519, 520, 548, 549, 553, 387; 446/475; 272/8 R, 8 N, 27 R, 27 N; 124/65, 71, 73, 81, 83, 85; 239/444, 446, 447, 394, 391, 392

[56] References Cited

U.S. PATENT DOCUMENTS

| | | | |
|---|---|---|---|
| D. 159,040 | 6/1950 | Bicos | 222/79 X |
| 933,961 | 9/1909 | Moulin | 222/79 |
| 956,760 | 5/1910 | Moulin | 222/79 |
| 1,031,526 | 7/1912 | Cloud, Jr. | 222/79 |
| 1,394,456 | 10/1921 | Wanat | 222/79 |
| 1,838,438 | 12/1931 | Nichols | 239/446 |
| 2,148,726 | 2/1939 | Brandt | 239/447 |
| 2,218,411 | 10/1940 | Albach et al. | 239/444 X |
| 2,530,808 | 11/1950 | Cerasi | 239/444 X |
| 2,546,120 | 3/1951 | Boroughs | 239/444 X |
| 3,058,670 | 10/1962 | Marotto et al. | 239/390 X |
| 3,117,696 | 1/1964 | Herman et al. | 222/137 |
| 3,191,809 | 6/1965 | Schultz et al. | 222/567 X |
| 3,311,265 | 3/1967 | Creighton, Jr. et al. | 222/137 |

FOREIGN PATENT DOCUMENTS

| | | | |
|---|---|---|---|
| 424096 | 5/1967 | Switzerland | 222/549 |
| 1914 | 9/1919 | United Kingdom | 239/394 |

*Primary Examiner*—Joseph J. Rolla
*Assistant Examiner*—Kevin P. Shaver
*Attorney, Agent, or Firm*—Laurence R. Brown

[57] ABSTRACT

A toy water shooting gun for shooting water in a plurality of directions with respect to the axis of the gun. The toy water gun is operable by a plunger/piston rod movable within a water storage cylinder. A cap having a plurality of apertures is located at the discharge end of the water gun and is rotatable to operate a valve to selectively align the apertures with the water cylinder for discharge therethrough. The apertures when in communication with the water cylinder discharge water in different directions, i.e., forward, rearward and sideways.

5 Claims, 13 Drawing Figures

TOY WATER GUN WITH A MULTIPLICITY OF OPERATION MODES

TECHNICAL FIELD

This invention relates to toy water guns and more particularly it relates to guns having a piston movable in a chamber for forcing a charge out of a nozzle aperture which feature operation in a plurality of modes.

BACKGROUND ART

Fluid discharging guns having movable piston rods and a fluid containing chamber have long been known as evidenced by U.S. Pat. No. 1,031,526—N. H. Cloud, Jr. —July 2, 1912. Also the operation of such guns in multiple modes is known as evidenced by U.S. Pat. No. 1,394,456—J. Wanat—Oct. 18, 1921, which discloses a combination pop gun, water gun and whistle attained by changeable outlet port structure.

However, it is an objective of this invention to produce a versatile toy water gun having various modes of operation as a water gun, which structure and versatility the prior art does not teach.

DISCLOSURE OF THE INVENTION

A water gun operable by a plunger piston rod movable in a water storage cylinder in accordance with this invention has a plurality of discharge apertures and manually operable valve means for selecting different operating modes related to operation of different discharge apertures. The water gun has even more flexibility in that a set of different replaceable nozzle orifice caps provide a larger range of selectable operation modes.

For example, nozzle apertures can be selected to shoot a stream of water selectively straight ahead, to one side or backward toward the plunger operator. Thus, the toy provides a range of games and tricks which may be played by selection of different nozzle caps and different valve settings.

Multiple barrelled guns may be used for greater storage capacity and a greater range of selectable operating modes. Simple and effective valve means is provided by simple rotation of a nozzle cap or plunger handle.

Other objects, features and advantage of the invention will be found throughout the following description, the drawings and the claims.

THE PREFERRED EMBODIMENTS

Figure 1:
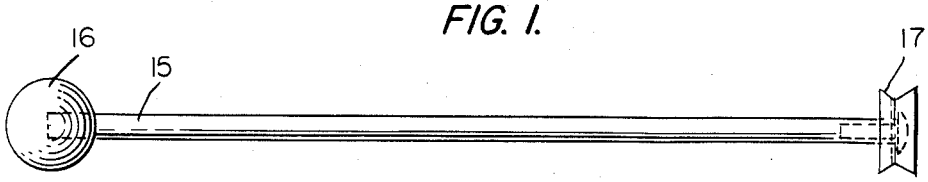
FIG. 1 is a side view sketch of a piston-rod-plunger assembly that operates inside the barrel-nozzle assembly as shown in the side view sketch, partly shown in section of FIG. 2.
Figure 2:
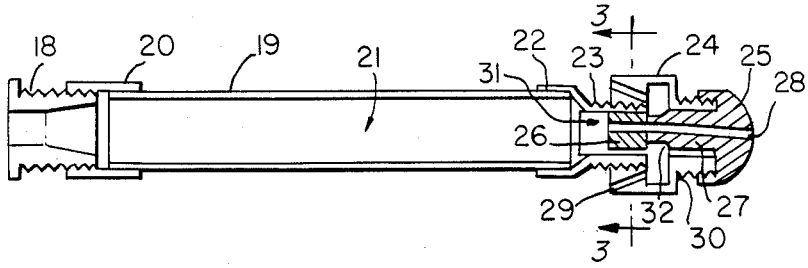
FIG. 2 shows a three directional water gun barrel assembly in cross-section.

As seen from FIGS. 1 and 2, a plunger comprises rod 15, such as a hollow aluminum tube, with hand grasp ball 16 affixed thereto on one end and a piston 17 at the other end. This plunger has rod 15 journalled in the screw in plastic fitting 18 carried by hollow tube 19, typically a hollow aluminum tube upon which joint 20 is glued, and which serves to define a cylinder chamber 21 for receiving and discharging water as sucked in or pumped out by the piston 17.

Similarly a joint 22 is glued at the orifice end of the chamber 19 having screw threads 23 for receiving a plurality of different types of nozzles 24, 25, etc. as will be made more clear hereinafter. Valve structure having internal plugs 26, 27 direct the flow of water from chamber 21 through one or more selected apertures from a plurality of apertures available such as forward shooting aperture 28 in nozzle 25 or rearwardly shooting aperture 29 in cap 24. Structure 26, 27 may be of any suitable material such as plastic, metal, rubber, etc. and are cross sectioned to distinguish the structure in this line sketch presentation. Note that valve structure plug 27 is integral with and rotatable with cap 25 on threads 30.

In operation, as shown in FIGS. 2 to 5, the valve plug structure 26, 27 serves to pass water from chamber 21 through channel 31 in the plug 26 in the discharge of joint 22. The mating rotary valve plug 27 integral with cap 25 serves to match an outlet path to two or more apertures such as 28 or 29 to discharge orifices selectable by turning cap 25. Thus the aperture 28 when not aligned with channel 31 will permit release of water to flow out backwardly facing apertures 29 toward handle 16 and the operator of the pump. Similarly as shown with orifice 28 aligned with channel 31 the gun fires water in the forward direction away from the handle 16. Note also the side shooting channel 33 (FIG. 4) in cap 25 that may be aligned with the channel 31 for shooting water sideways. It is clear therefore that simple selection valve structure such as rotatable cap 25 will permit selective discharge of water in a plurality of different directions. A variety of interchangeable caps 24 and 25 may be provided with different choices and variations.

Note that in the FIG. 2 version an outer cap 25 without aperture holes can easily be replaced to provide a valve changing structure permitting the water gun to shoot backwards only. Note also that the plug portion 27 need be turned by orifice cap 24 and the plug portion 26 is stationary. Outer cap 25 turns relative to plug 27.

Figure 11:
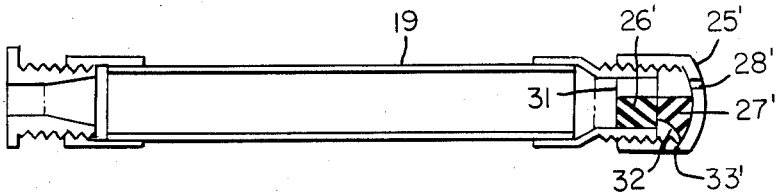
FIG. 11 is a cross-section view of a two directional water gun barrel assembly for front and side shots.

A simpler two directional gun barrel 19 assembly in FIG. 11 has similar plugs 26' and 27' and only the outer cap 25' with two orifices, namely 28' for forward shooting and 33' for sideways shooting. Thus, the cap 25' is rotatable from the shown forward shooting position to turn plug 27' therewith and align the notch 32 with channel 31 to shoot sideways out nozzle 33'.

Figure 12:
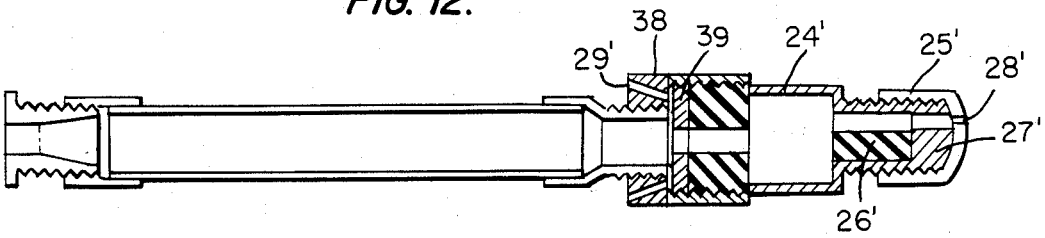
FIG. 12 is a cross-section view of a two directional barrel assembly embodiment for front and rear shots.

A two directional gun embodiment as shown in FIG. 12 will permit forward and/or backward shooting. It is seen that by turning cap 24' the gasket 39 either seals or opens the backward orifices 29' in fitting 38. The plug 27' turns with cap 25' to either open or close the water channel to outlet orifice 28'. Plug 26' is stationary in inner cap member 24'.

Figure 3:
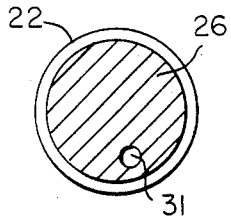
FIG. 3 shows an end view, partly in section of the barrel and a part of the valve looking from the right into the barrel along lines 3—3 of FIG. 2.
Figure 4:
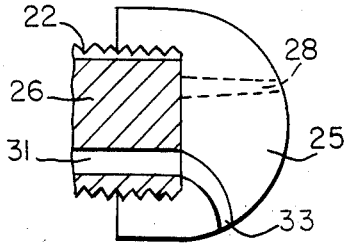
FIG. 4 is a fragmented side view, partly in section of the valve-barrel assembly of FIG. 3 having only a single replaceable nozzle cap embodiment thereon.
Figure 5:
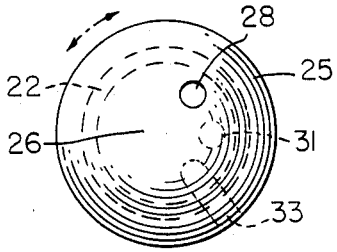
FIG. 5 is an end view of the cap looking from the right in FIG. 4.
Figure 6:
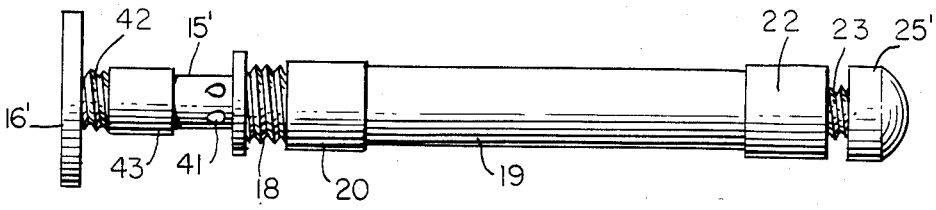
FIG. 6 is a side view of an assembled further embodiment of the invention, with FIG. 6A being an end view of the nozzle cap looking into the right of FIG. 6, and FIG. 7 a side view of the plunger-piston-rod assembly of the FIG. 6 embodiment.
Figure 6A:
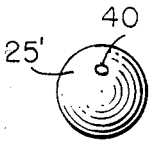
Figure 7:
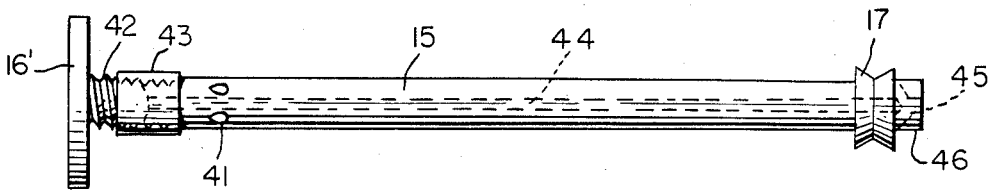

FIGS. 6 and 7 show a further embodiment that discharges both in forward and backward directions. Like reference characters permit comparison of similar pats, and primed reference characters indicate slightly modified versions. Note for example nozzle cap 25' has only one forward shooting orifice 40 located off center so that by rotation of the cap 25', the water path out orifice 40 may be opened or blocked selectively, as illustrated in FIGS. 3 to 5.

In the embodiment of FIGS. 6 and 7 hollow push rod 15 has rearwardly extending orifices 41 and a control valve arrangement therefore comprising handle 16' rotatable by screw threads 42 in collar 43 to position internal needle valve 44 into the orifice 45 of screw head 46 holding on the piston 17. Thus, when handle 16' releases the needle rod 44 to the left from aperture 45 and opens it when aperture 40 is closed, water flows freely from the chamber inside tube 19 out apertures 41 toward the handle 16' and the operator. If the needle valve is closed, and aperture 40 is open, then water flows only out the nozzle cap 25 and aperture 40. Since several holes 41 are available the friction of single aperture 40 being greater, most of the water shot out by movement forward (to the right) of plunger rod 15 will pass out in the rearward direction even if the aperture 40 is open.

Figure 8:
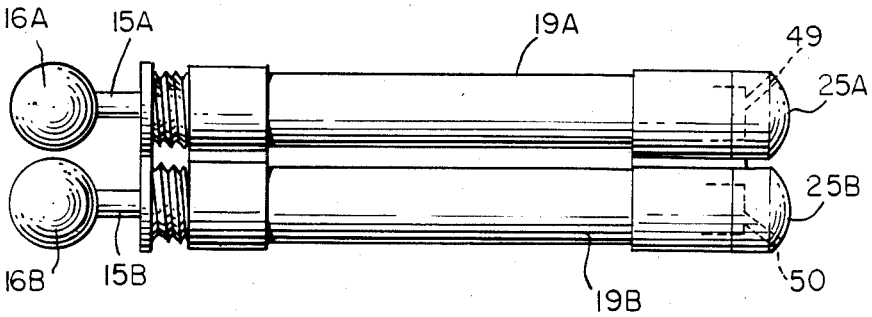
FIG. 8 is a side view sketch of another embodiment of the invention with two parallel barrels.
Figure 9:
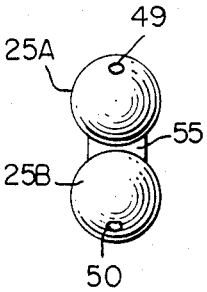
FIG. 9 is a sketch looking into the right of FIG. 8 at the end cap.

Another dual barrelled embodiment is shown in FIGS. 8 and 9. As seen by apertures 49, 50, this version can shoot out at two different angles from the corresponding slanted apertures in caps 25A and 25B. One advantage of this version is more water storage capacity. Another is the choice of either independent or dual action of the two plungers 15A, 15B. The two units are held together by a suitable bracket.

Figure 10:
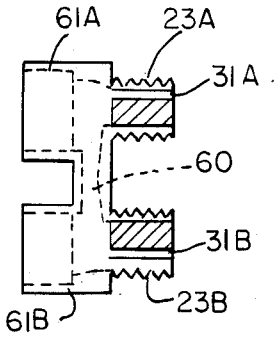
FIG. 10 is a side view sketch, partly in section of an end cap adaptor assembly for the FIG. 8 embodiment.

As seen in FIG. 10 the bracket may also include a water communication channel 60 between the two chambers. The sleeves 61A and 61B may slip respectively over the tubings 19A and 19B and be glued thereto. As in the prior arrangements, by use of appropriate nozzle caps having nozzle outlets alignable with respective channels 31A or 31B, a multiplicity of operating modes may be manually selected to shoot water out nozzles in various directions.

Having therefore described the invention and its operation, those features of novelty believed descriptive of the spirit and nature of the invention are set forth with particularity in the claims.

I claim:

1. A toy water shooting gun comprising a longitudinal cylinder having a water retaining chamber and a water discharge end, a nozzle for discharging a stream of water connected to the water discharge end of said chamber, and a movable piston within said cylinder externally operated for loading and discharging water therefrom, the improvement comprising a rotatable cap having a plurality of apertures therethrough for discharging a water stream in one of several selectable different directions and valve means for selectively connecting one of said plurality of apertures to the cylinder discharge end for discharging a water stream through the selected single aperture, wherein said nozzle includes said rotatable cap carried thereby, said valve means including a channel passing through a first plug carried by said cylinder discharge end and wherein the valve means further comprises a second relatively rotatable plug carried by said nozzle cap positionable upon rotation of said cap to align said channel of said first plug with said selected aperture to discharge a stream of water from said gun upon actuation of said piston within said cylinder.

2. The toy defined in claim 1 wherein individual ones of the nozzle cap apertures direct discharged water in different directions.

3. The toy defined in claim 1 wherein one aperture of said plurality of said apertures directs water in a direction substantially perpendicular to the cylinder means.

4. The toy defined in claim 1 wherein one aperture of said plurality of said apertures directs water in a direction substantially rearward along the cylinder means in the direction of an operator of the piston.

5. In a toy water shooting gun comprising a longitudinal cylinder providing a chamber for retaining water, nozzle means at the discharge end of said chamber for discharging water, and a movable piston movable within the cylinder for loading and discharging water, the improvement comprising a plurality of nozzles having apertures for discharging water and valve means for selectively connecting different ones of said apertures to the discharge end of cylinder for water discharge therethrough, wherein the movable piston includes a hollow operating plunger shaft extending from the cylinder and terminating in an operating handle, one of said apertures being in said hollow plunger shaft rearwardly directed toward and proximate the handle, and said valve means being operable by the handle for selectively admitting water from said cylinder chamber into the hollow shaft.

* * * * *